US005082427A

United States Patent [19]

Fujiwara et al.

[11] Patent Number: 5,082,427

[45] Date of Patent: Jan. 21, 1992

[54] SCREW COMPRESSING APPARATUS, ROTOR TEMPERATURE CONTROL APPARATUS FOR SCREW COMPRESSING APPARATUS AND OPERATING CONTROL APPARATUS FOR SCREW COMPRESSING APPARATUS

[75] Inventors: Mitsuru Fujiwara, Ibaraki; Akira Suzuki, Shimizu; Junji Okita, Ishioka, all of Japan

[73] Assignee: Hitachi, Ltd., Tokyo, Japan

[21] Appl. No.: 532,812

[22] Filed: Jun. 4, 1990

[30] Foreign Application Priority Data

Jun. 5, 1989 [JP] Japan ..... 1-141028

[51] Int. Cl.[5] ..... F04B 49/06

[52] U.S. Cl. ..... 417/292; 417/32; 417/310; 418/15; 418/201.2

[58] Field of Search ..... 417/32, 292, 306, 310; 418/15, 201.2; 62/505

[56] References Cited

U.S. PATENT DOCUMENTS 3,795,117 3/1974 Moody et al. ..... 62/505 X
3,913,346 10/1975 Moody et al. ..... 62/505 X
4,475,878 10/1984 Kasuya et al. ..... 418/201
4,812,110 3/1989 Kubo et al. ..... 418/15 X

FOREIGN PATENT DOCUMENTS 203477 12/1986 Japan ..... 418/15
12752 12/1989 PCT Int'l Appl. ..... 418/201.2

*Primary Examiner*—Stephen M. Hepperle
*Attorney, Agent, or Firm*—Antonelli, Terry, Stout & Kraus

[57] ABSTRACT

In the screw compressing apparatus, by rotating paired male and female rotors as meshing with each other, a gas is suctioned from a suction chamber into a working space, and compressed in the working space. The compressed high pressure gas is exhausted from a exhaust chamber, and then cooled by an aftercooler, thereby producing a low temperature, high pressure gas. In the compression process, the temperature of the gas in the working space becomes high at the exhaust chamber side. When this exhaust gas temperature reaches a predetermined value, a part of the gas cooled by an aftercooler is injected into the working space for lowering the temperture in the working space.

4 Claims, 2 Drawing Sheets

SCREW COMPRESSING APPARATUS, ROTOR TEMPERATURE CONTROL APPARATUS FOR SCREW COMPRESSING APPARATUS AND OPERATING CONTROL APPARATUS FOR SCREW COMPRESSING APPARATUS

BACKGROUND OF THE INVENTION

1. Technical Field

The present invention relates to a screw compressor including meshing male and female screw rotors rotating about two axes parallel to each other, and defining a working space in cooperation with a casing, and, especially, to a screw compressor of oil-free type which requires no oil to be supplied to the working space.

2. Relative Art

In a screw fluid machine treating a gas, such as a compressor, an expander, a vacuum pump and so on, the temperature of the gas at the high pressure side becomes high and, generally, for example, as high as 300° C. in a screw compressor of oil-free type having a gas compression ratio 8. As a result, the thermal expansion of the rotors becomes a considerable amount. For solving this problem in, for example, U.S. Pat. No. 4,475,878, the amount of clearance between the rotors is determined taking into consideration this thermal expansion so that the rotors do not contact each other even in operating condition of the compressor. Further, heretofore, for suppressing errors in estimating thermal expansion amount and for assuring the strength of the material and the reliability of the bearing parts, several measures have been attempted such as, for example, cooling the compressed gas by providing a water jacket in the casing, or the rotors by passing a cooling oil through axial holes formed in the central portions of the rotors.

SUMMARY OF THE INVENTION

In a screw compressor of oil-free type, when, for example, the load is changed from a full load condition to a partial load condition, namely, in a transition process of the load, or when the temperature of the gas to be suctioned is raised abnormally high due to an extra factor, the temperature of the compressed gas becomes high and accordingly, the temperature of the rotors also becomes high. In such a case, with an insufficient margin of clearance between the rotors, the rotors ma contact with each other due to the thermal expansion of the male and female rotors, thereby causing a vital damage of the compressor.

In the above-mentioned prior art although the rotors are adapted to be cooled, there is no means to control the temperature of the rotors according to the operational conditions. In other words, there is no direct means for treating an abnormal temperature rise of the rotors, but the amount of the clearance between the rotors is determined in consideration of an abnormal thermal expansion of the rotors in advance for assuring the reliability of the compressor. As a result, the clearance is unnecessarily wide in a normal operation, thereby causing a great power loss. In other words, a problem in the prior art resides in the fact that, the margin of the clearance must be decreased for decreasing the power loss in a normal operation and enhancing the efficiency of the compressor, but the decreased clearance lowers the reliability of the compressor.

One of the reasons for the fact that the temperature of the rotors has not been controlled is that the heat amount of the gas generated in the compressor is great, and indirect cooling means such as of passing a cooling oil through the central portions of the rotors or providing a water jacket in the casing has problems with respect to cooling capacity or response feature, and that it is difficult to control the temperature of the gas and the rotors rapidly according to the conditions.

An object of the present invention is to provide a screw compressing apparatus in which the temperature of the rotors in operation is controlled and a high reliability and an efficient operation can be assured.

Another object of the present invention is to provide an operation control apparatus which controls the operation of a compressing apparatus according to the temperature of the rotors.

A screw compressing apparatus according to the present invention comprises a screw compressor body including paired male and female rotors rotating about two axes parallel to each other, respectively, while meshing with each other, and defining a working space, and a casing having a suction chamber and an exhaust chamber and accommodating the male and female rotors. An aftercooler is arranged at the exhaust port side of the compressor body, and an exhaust gas temperature detecting means detects the exhaust gas temperature at a position between the exhaust chamber of the screw compressor body and the aftercooler. A gas injection port communicates with the working space, and a gas passage connects the gas injection port with the outlet side of the aftercooler with a passage opening and closing means interposed therebetween. A controller controls the passage opening and closing means so as to open the passage opening and closing means for injecting a low temperature, high pressure gas to the rotors when the exhaust gas temperature detected by the exhaust gas temperature detecting means becomes exceeds a predetermined value to close the passage opening and closing means for stopping the injection of the low temperature, high pressure gas when the exhaust gas temperature is lower than a predetermined value. When the compressed gas temperature becomes high in, for example, a transition period from a full load condition to a partial load condition, or in case of a sudden increase in suction gas temperature due to an external factor, the rise of the temperature is detected by the exhaust gas temperature detecting means, and a command signal is transmitted to the controller for opening the passage opening and closing means. And just then, the low temperature, high pressure gas downstream of the aftercooler is injected towards the rotors, thereby cooling the rotors. Further, the injected low temperature gas mixes with the high temperature gas in the working space, thereby lowering the gas temperature, and, accordingly, the rotor temperature. As a result, an abnormal thermal expansion of the rotors can be prevented, and the male and female rotors do not contact with each other, thereby assuring a highly reliable operation at all times.

Consequently it becomes unnecessary to provide an excessive margin for the clearance between rotors in advance in consideration of an abnormal temperature rise of the rotors. Thus, the clearance in a normal operation can be decreased and the efficiency of the compressor ca be enhanced.

PREFERRED EMBODIMENTS OF THE INVENTION

Figure 1:
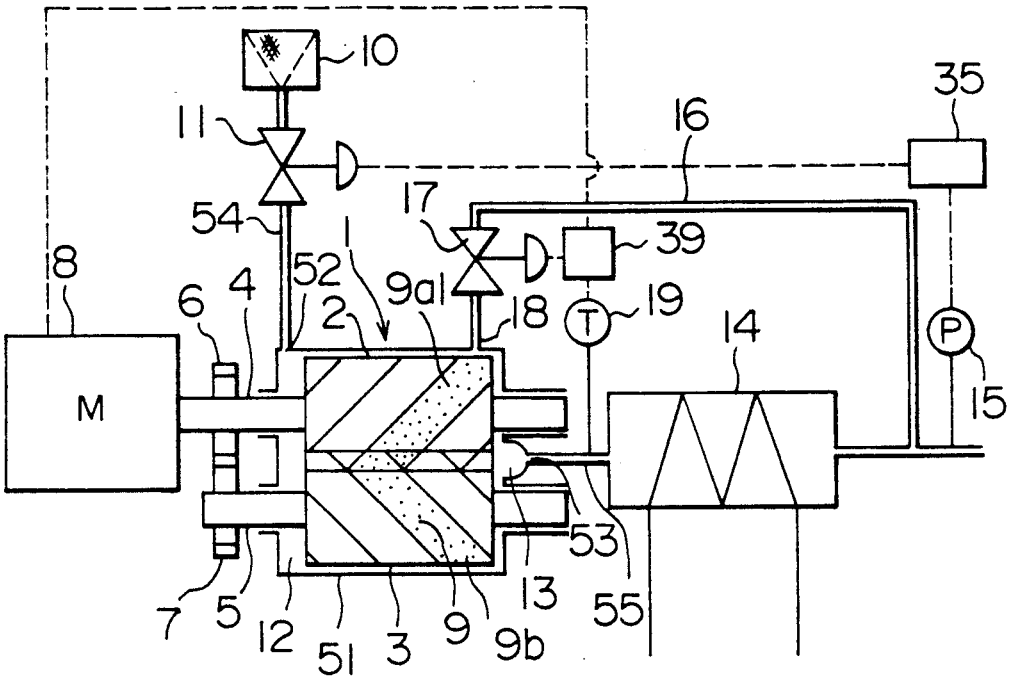
FIG. 1 is a schematic view of a screw compressor according to an embodiment of the present invention.

Referring now to the drawings wherein like reference numerals are used throughout the various views to designate like parts and, more particularly, to FIGS. 1–4, according to these figures, a screw compressor in accordance with the present invention includes a compressor body 1 composed of paired male rotor 2 and female rotor 3 respectively rotating about two axes parallel to each other, while meshing with each other, and a casing 51 having a suction port 52 and an exhaust port 53 and bore walls intersecting each other and respectively accommodating the male rotor 2 and the female rotor 3.

A rotary shaft 4 provided at one end of the male rotor 2 is connected with an electric motor 8 for driving the male rotor 2. On the rotary shaft 4 and on a rotary shaft 5 provided at one end of the female rotor 3, there are respectively mounted a gear 6 and a gear 7. By virtue of the paired gears 6, 7, the rotors 2, 3 are rotated in synchronism. Each of the rotors 2, 3 is formed with a twisted tooth, and the rotors rotate with their teeth meshing with each other. By virtue of the function of synchronous rotation of the gears 6, 7, there is always maintained a narrow clearance between the meshing teeth of the male and female rotors 2, 3.

The groove between the teeth defines a working space of the screw compressor. A fair of the grooves at the male rotor side and the female rotor side as shown with numerals 9*a* and 9*b* in FIG. 1 define an individual working space 9 which is separated from another working space defined by the other paired grooves.

In the casing 51 are formed a suction chamber 12 communicating with the suction port 52 and an exhaust chamber 13 communicating with the exhaust port 53. To the suction port 52 is connected a suction pipe 54 provided with a suction filter 10 and a control valve 11, while to the exhaust port 53 is connected an exhaust pipe 55 communicating with an aftercooler 14. As the rotors 2, 3 rotate, the volume of the working space 9 is changed, while the gas is suctioned through the suction port 52, compressed and exhausted through the exhaust port 53.

During these suction, compression and exhaustion processes, the exhaust gas pressure is detected by a pressure detector 15 provided in the exhaust pipe 55. A controller 35 transmits a command signal for controlling the opening degree of the control valve 11 based on the pressure detected by the pressure detector 15.

A gas injection port 18 opens at the casing 51 of the compressor body 1 as facing to the outer periphery of the rotors at a position near an end of the casing 51 located on the exhaust chamber 13 side. The gas injection port 18 and the outlet portion locating downstream of the aftercooler 14 of the exhaust pipe 55 are connected with each other through a gas passage 16. Consequently, the low temperature, high pressure gas having passed through the aftercooler 14 is injected into the working space 9 in the compressor body 1 at a position locating at the exhaust chamber side. In the gas passage 16 is provided an electric valve 17 serving as a first passage opening and closing means. In the exhaust pipe 55 extending from the exhaust chamber 13 in the compressor body 1 to the aftercooler 14 is provided an exhaust gas temperature detector 19 for detecting the exhaust gas temperature. Instead of this arrangement, the gas temperature in the exhaust chamber 13 may be detected and used as an exhaust gas temperature. The signal from the detector 19 is inputted into a controller 39. The electric valve 17 is controlled to open or close, based on the command signal from the controller 39, and passes or shuts the low temperature, high pressure gas having passed through the aftercooler 14 to the injection port 18.

Next, the structure and the function of screw compressor according to this embodiment will be described below more in detail. A gas is introduced into the suction room 12 through the suction filter 10 mounted on the suction pipe 54 and the control valve 11, and then, suctioned into grooves defined by both rotors 2, 3, compressed therein, and exhausted to the exhaust chamber 13. The gas exhausted from the exhaust port 53 through the exhaust pipe 55 is compressed to be of high temperature. After the high temperature gas is cooled by the aftercooler 14, the gas is delivered to terminal equipments in usage. The gas temperature at the exit port of the aftercooler 14 is equal to or higher by several ten degrees C than the atmospheric temperature. The aftercooler 14 may be of a water cooling type or an air cooling type.

At the exhaust side of the compressor is provided a pressure detector 15, and according to the exhaust gas pressure detected, a command signal is transmitted from the capacity controller 35 for increasing and decreasing the opening degree of the capacity control valve 11, thereby adjusting the suction gas flow rate. The pressure detecting position of the pressure detector 15 is not limited to the position shown in FIG. 1, but may be located upstream of the aftercooler 14, in the aftercooler, or in a gas tank arranged downstream of the aftercooler 14. When the pressure detected by the pressure detector 15 is lower than a predetermined value, the control valve 11 is fully opened, resulting in a full load condition of the compressor. When the gas amount used in the terminal equipments is decreased, the pressure in the exhaust pipe system of the compressor rises, and is detected by the pressure detector 15. When this pressure is higher than a predetermined value, the control valve 11 is closed for decreasing the suction gas flow rate, namely, presenting a partial load operation. The opening and closing operation of the control valve 11 may be of an on-off type operated according to the pressure in the exhaust pipe system, or of a stepless, continuous control type operating the opening degree according to the pressure difference between the detected pressure and the predetermined pressure value.

The low temperature gas at the exit side of the aftercooler 14 is injected into the working space 9 from the gas injection port 18 formed in the casing 51 through the gas passage 16 under the control of the electric valve 17.

Although, in FIG. 1, the gas injection port 18 is located at a position facing to the outer peripheral surface of the male rotor 2, gas injection ports may be opened as facing the outer peripheral surfaces of both male and female rotors 2, 3. The opening and closing of the electric valve 17 is conducted in response to a command signal from the controller 39 according to the exhaust gas temperature detected by the exhaust gas temperature detector 19 (hereinafter, referred to only as temperature detector).

The detecting position of the exhaust temperature may be located in the exhaust chamber of the compressor, at the entrance port of the aftercooler, or in a pipe connecting these members. The position in or near the exhaust chamber 13 is, however, preferred in due consideration of the response speed.

In a normal condition, the electric valve 17 is closed, and no low temperature gas is supplied to the working space 9. On the other hand, when the exhaust gas temperature abnormally rises due to some reason, the, temperature is detected by the temperature detector 19 and judged by the controller 39, which transmits a signal to the electric valve 17 for opening the electric valve 17. When the electric valve 17 is opened, the low temperature gas is injected from the gas injection port 18 to the outer peripheral surfaces of the rotors. The injected gas cools the rotors, and, at the same time, mixes with the high temperature gas in the working space, and then, the mixed gas is again compressed and exhausted into the exhaust chamber 13. By mixing the low temperature gas, the exhaust gas temperature is lowered together with the rotor temperature.

When the exhaust gas temperature becomes lower than a predetermined Prestared value stored in the controller 39, the temperature is detected by the temperature detector 19, and a command signal is transmitted from the controller 39 for closing the electric valve 17 and stopping the injection of the low temperature gas. In case the exhaust gas temperature rise is caused by a temporary abnormal operational condition, the above-mentioned measure can be an effective solution. In case, however, the reason for the exhaust gas temperature rise is serious, a continuous operation give rise a vital damage to some members other than the rotors. Therefore, in case the exhaust gas temperature can not be lowered below the set temperature value stored in the controller, even when the electric valve 17 is opened and a low temperature gas is injected, and the gas temperature continues to be high over a predetermined time length, the electric motor 8 is stopped in response to a command signal from the controller 39, and, at the same time, an alarm informs the operator of abnormal behavior of the compressor.

The opening and closing of the electric valve 17 may be of an on-off type in which a fully opened condition and a fully closed condition are switched according to a command signal from the temperature detector 19. However, a control of continuous type in which the opening degree of the valve can be controlled in proportion to the difference between the exhaust gas temperature and the predetermined temperature value assures a more precise control of the rotor temperature.

It is possible to construct the temperature detector 19, the controller 39, and the electric valve 11 as an integrated single unit. Instead of the electric valve 11, an shut-off valve operated by a mechanical power can be used. Especially, if a valve controlled in accordance with the temperature of the exhaust pipe 55 by using a bimetal or a shape memory alloy is used, the integration of the structures becomes easier.

The grooves of rotors defining a working space change their positions as the rotors rotate, and the volume of the working space changes as the positions change. Therefore, the injection timing in the compressing cycle varies in dependence upon the position of a gas injection part of the cooling gas. Although a plurality of gas injection ports may be provided, a gas injection from one injection port into one groove continues only for a period during which the injection port 18 is facing to the groove, this means, a period corresponding a rotation of the rotor by an angle equivalent to one tooth.

Figure 2:
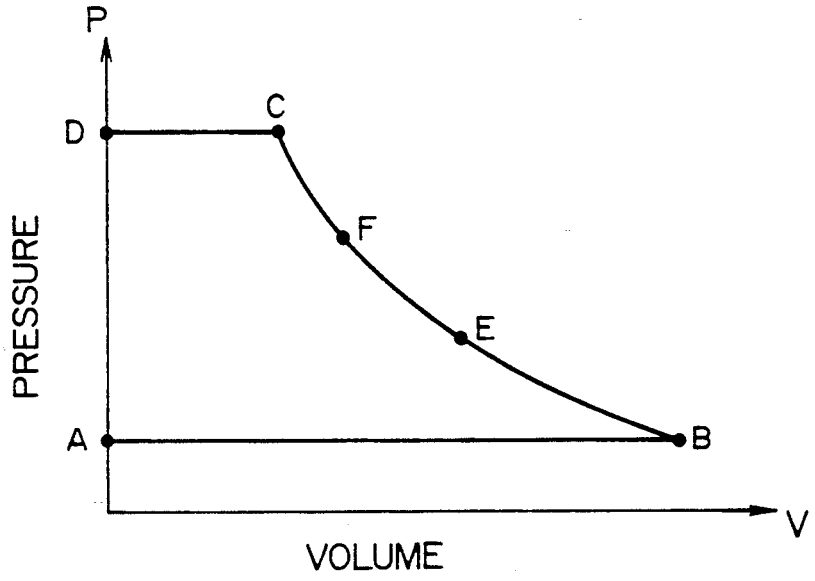
FIG. 2 is a P-V diagram indicating relationship between the pressure and the volume of the gas in the working space of the screw compressor shown in FIG. 1.

FIG. 2 is a P-V diagram indicating a relation between the pressure (P) and the volume (V) of the gas in the working space 9. In FIG. 2, the process from A to B is a suction stroke, the process from B to C is a compression stroke, and the process from C to D is an exhaust stroke.

Assuming the injected gas temperature is equal to the suction gas temperature, if all amount of the gas is injected at the point B where a compression stroke starts, no cooling effect can be expected. As the injection point shifts from the point B to the point C, the decrease of the exhaust gas temperature is significant if the injection gas amount is maintained to be the same.

On the other hand, the injected gas must be compressed to the exhaust gas pressure value, and this re-compression power means a loss of the compressor power. For decreasing the re-compression power, the injection position is desired to be near the point C. Beyond the point C, however, the supply pressure of the cooling gas becomes equal to the pressure in the working space to be injected, thereby making the injection impossible.

As mentioned above, a gas injection from one injection port continues only for a period corresponding a rotation of the rotor by an angle equivalent to one tooth. For example, in FIG. 2, assuming that an injection starts at the point E and finishes at the point F, the rotor rotates at most by an angle equivalent to one tooth during the process from the point E to the point F. The reason of using the term "at most" is because the tooth of the rotor has a thickness and the injection port is closed by the tooth for some time period. Essentially, however, the process from the point E to the point F may be understood to correspond to the interval of the teeth.

When the point E is shifted towards the point C, the point F also approaches to the point C. It is desired to select the position of the gas injection port 18 so that the point F falls on the point C or beyond the point C, namely, so that the injection starting position is located within an angular range corresponding one tooth extending from the exhaust process starting point towards the compression starting point. If the injection starting position is located upstream of this angular range, there occurs an ineffective section (F-C) in which no cooling function is expected, and accordingly, the points E and F are shifted towards the point B, thereby decreasing the cooling effect and increasing the re-compression power for the reason noted above. Therefore, it is desired to decrease the above-mentioned ineffective section as much as possible. In case the point E approaches to the point C, for the above-mentioned reason, the cooling is also enhanced and the recompression power is decreased, and in case the point E is shifted beyond the point C, the injection becomes impossible because of an adverse pressure difference.

During the operation of rotors of the screw compressor, the temperature distribution is generally not uniform in general, but with respect to the rotary axis direction, high at the exhaust chamber 13 side and low at the suction chamber 12 side. A fear that the rotors contact with each other due to a temperature rise of the compressed gas occurs mainly at a portion near the exhaust chamber. Since the grooves of the screw compressor are twisted, a working space has some axial length. The gas injection port 18 is preferably located at a position near the side end surface of the exhaust chamber with respect of the same working space.

Although, in the embodiment shown in FIG. 1, the gas injection port 18 is located at a position facing to the outer peripheral surface of the rotor, the same effect can be obtained by locating the gas injection port at a position facing to the end surface on the exhaust side of the rotor. However, the position facing to the peripheral surface is more effective, because the period when the injection is interrupted by the teeth is shorter and the cooling gas is directly injected to the tip of the rotor tooth where the temperature is especially high.

According to this embodiment, when the compressed gas temperature becomes high, for example, in a transition period from a full load condition to a partial load condition, or in case of a sudden rise in the suction gas temperature due to an external factor, the low temperature gas is directly injected towards the rotors, and further, the injected low temperature gas mixes with the high temperature gas in the compression chamber (working space), thereby lowering the gas temperature. As a result, an abnormal thermal expansion of the rotors can be prevented and a highly reliable operation is assured at all times.

Therefore, it is not required to provide an excessive margin of the clearance between rotors in advance in consideration of abnormal conditions as in the prior art, and accordingly, a gas leak loss can be minimized.

It usually causes a power loss to return a gas having passed through an aftercooler. According to the present invention, however, no gas is returned in a normal operation, and no power loss is caused. The gas is returned only in a state of emergency, such as, as mentioned above, in a transition period from a full load condition to a partial load condition, or in case of a sudden abnormal rise of the suction gas temperature due to an external factor. In a partial load condition, there is an ample supply of exhaust gas, and a state of emergency does not frequently occur. In any case, the power loss caused by returning the gas is small on the whole, but the decrease of the power loss obtained by narrowing the clearance between rotors in a normal condition is significant.

Next, referring to FIGS. 3 and 4, another embodiment of the present invention will be described below.

Figure 3:
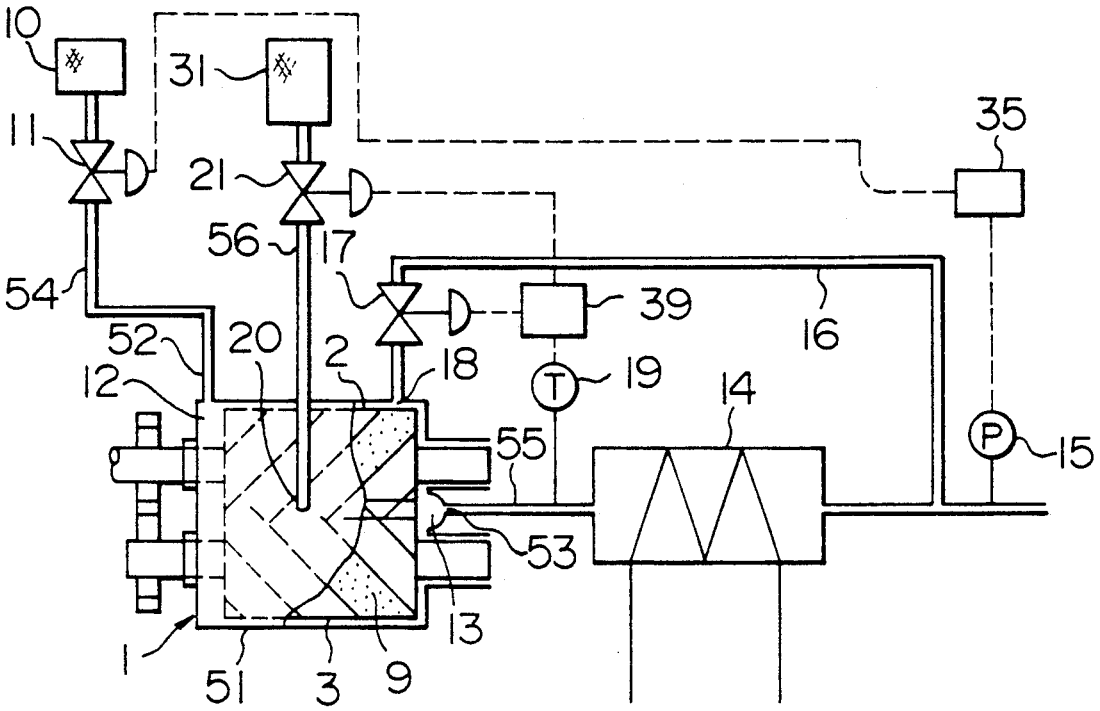
FIG. 3 is a schematic view of a screw compressor according to another embodiment of the present invention.
Figure 4:
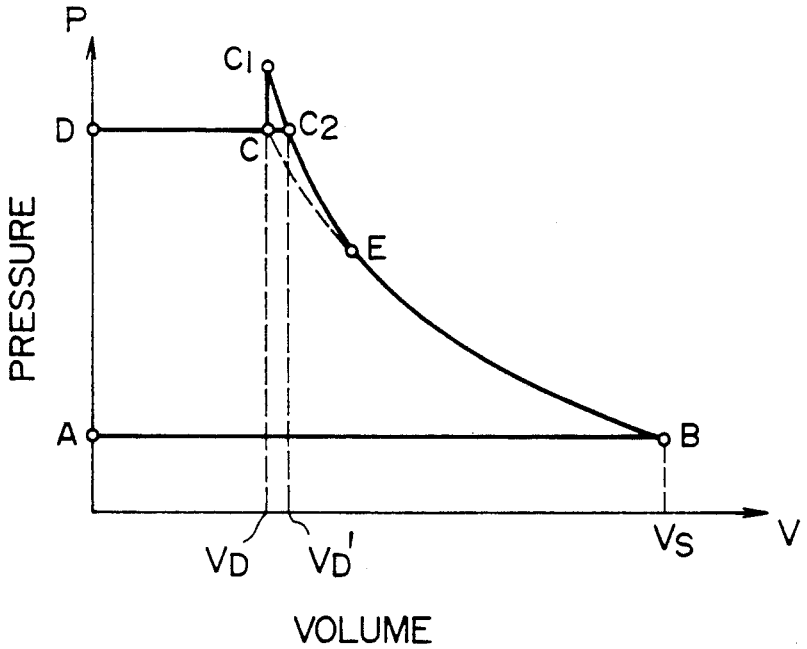
FIG. 4 is a P-V diagram indicating a relationship between the pressure and the volume of the gas in the working space of the screw compressor shown in FIG. 3.

In the embodiment of FIG. 3, an exhaust port 20 opens at a portion of a casing 51 so as to face to a working space 9 and is connected with an exhaust pipe 56. To the exhaust pipe 56 is connected an electric valve 21 serving as a second passage opening and closing means, which is opened and closed based on a command signal from a controller 39. In FIG. 3, as in the embodiment of FIG. 1, when the exhaust gas temperature of the compressor rises beyond a predetermined value, the temperature is detected by a temperature detector 19, and judged by a controller 39, which transmits a command signal to an electric valve 17 and the electric valve 21 for opening these valves.

When the electric valve 17 opens, a low temperature gas flowing downstream of an aftercooler 14 is injected to the rotors through a gas injection port 18. At the same time, the electric valve 21, which is linked with the electric valve 17, is also opened, and a part of the compressed gas in the working space 9 is exhausted through the exhaust port 20 to the atmosphere. In other words, by opening the electric valves 17 and 21, a part of the high temperature gas in the working space 9 is replaced with a low temperature gas downstream of the aftercooler 14, thereby lowering the rotor temperature.

Since the injected gas from the gas injection port 18 must be compressed again to the pressure of the exhaust gas, the driving power is required to be increased. In case the power of the motor has no sufficient margin, it is effective to draw out a part of the high temperature gas in the working space, as practiced in this embodiment.

The position of the exhaust port 20 is desirably located in the same working space 9 as remote as possible from the gas injection port 18, because the replacement of the gas is effectively carried out and a better cooling effect can be obtained by virtue of this arrangement. Further, with respect to the rotor rotation, the timing when the low temperature gas is injected through the gas injection port 18 and the timing when the gas is exhausted by opening of the exhaust port 20 to the working space 9 are not necessarily required to be synchronized, but, for improving the gas replacement, it is rather preferred to delay the opening of the exhaust port 20 to the working space 9 relative to the opening of the gas injection port 18.

For decreasing the power required for re-compression, it is also effective to advance the opening timing of the exhaust port.

An exhaust stroke in a screw compressor starts when the working space reaches the exhaust port and crosses the boundary of the exhaust port. Therefore, the exhaust stroke starting timing can be changed by changing the position of the exhaust port. For expressing the exhaust stroke starting timing, there is frequently used a value $\pi_i$ expressed as follows.

$$\pi_i = \left(\frac{V_S}{V_D}\right)^{\kappa} \tag{1}$$

where, $V_S$ and $V_D$ indicate working space volumes at a suction completing timing and at an exhaustion starting timing, respectively, and $\kappa$ indicates a specific heat ratio of the working gas.

As well known, in a screw compressor of prior art, $\pi_i$ is determined to be equal to the operational pressure ratio of the compressor. When the position of the exhaust port is determined as mentioned above, there is no power loss, because the exhaust port opens just when the pressure of the compressed gas in the working space reaches the exhaust pressure.

However, as seen in the present invention, if a gas is injected from the outside into the working space on the middle of the compression stroke, the pressure in the working space becomes greater in comparison with in a case of no gas injection. Namely, in the P-V diagram of FIG. 4, a compression is carried out from E to C along the broken line, and at the point C where the pressure becomes equal to the exhaust pressure, the exhaust port opens and an exhaust process starts. When the gas is injected at a point beyond E, a compression is carried out beyond $C_2$ in the P-V diagram and as far as to $C_1$, where the exhaust port opens, and the gas in the working space is excessively compressed so as to have a pressure considerably higher than the exhaust pressure. Considering the above problem, the timing of opening the exhaust port is slightly advanced and when the volume reaches $V_D'$ the exhaust port open for preventing the over-compression and decreasing the power required for re-compression of the injection gas. In other words, in case of injecting a cooling gas, for preventing the over-compression, it is desired to determine the above-mentioned $\pi_i$ rather small depending on the exhaust port opening timing, or to provide an additional valve which opens only when the cooling gas is injected.

According to the embodiment of FIG. 3, the advantage obtained by the embodiment of FIG. 1 can be also expected. In addition, since a part of the high temperature gas in the working space is replaced by a low temperature gas downstream of the aftercooler, there is obtained a special advantage of this embodiment that the cooling effect on the rotors is significant and the over-compression can be prevented.

Further, for restricting the additional power required for re-compression of the gas, it is also effective to throttle down the flow rate control valve on the suction side and to lower the suction pressure when the gas is injected. That is, in FIG. 1, when the flow rate control valve 11 is throttled down, the suction pressure lowers and the additional power of the compressor decreases. Accordingly, when the flow rate control valve is throttled down at the same time as the electric valve 17 is closed, the power for re-compression of the gas injected from the gas injecting port 18 and the decreasing additional power due to the lowering suction pressure cancel each other out and the compressing power does not increase.

As mentioned above in detail, according to the present invention, there is provided a screw compressor in which the rotor temperature during operation can be controlled with a high response, and a high reliability and a high efficiency of the operation are assured.

What is claimed is:

1. A screw compressing apparatus, comprising:

a screw compressor body including paired male and female rotors respectively rotating about two axes parallel to each other while meshing with each other, and a casing having a suction chamber communicating with a suction pipe and an exhaust chamber communicating with an exhaust pipe and accommodating said male and female rotors, an aftercooler disposed at said exhaust chamber side of said screw compressor body, an exhaust gas temperature detecting means disposed in one of said exhaust chamber of the compressor body and a pipe system extending from said exhaust chamber to said aftercooler for detecting the exhaust gas temperature, a gas injection port formed in the screw compressor body, said gas injection port being located so as to communicate with said working space only at a position located in at least an angular region extending from the exhaust process starting position towards the compression process starting position by an angular amount corresponding to one rotor tooth, a first gas passage connected with said gas injection port for introducing a gas having passed through said aftercooler through a first passage opening and closing means, a second gas passage connected with said gas exhaust port through a second passage opening and closing means, a controller for controlling the opening and closing of said first and second passage opening and closing means according to the exhaust gas temperature, a flow rate control valve disposed in said suction pipe for controlling a flow rate of the suction gas, and a controller for controlling said flow rate control valve according to the exhaust gas pressure.

2. A screw compressing apparatus, comprising:

a screw compressor body including paired male and female rotors respectively rotated about two axes parallel to each other while meshing with each other with narrow clearances remaining therebetween and defining a working space, a casing having a suction chamber and an exhaust chamber and accommodating said male and female rotors, and a pair of gears each mounted on each of the shaft ends of said rotors for transmitting a rotating power from one rotor on the driving side to the other rotor on the following side and synchronizing the rotation of the rotors, an aftercooler disposed at said exhaust chamber side of said compressor body, an exhaust gas temperature detecting means for detecting the exhaust gas temperature disposed in one of said exhaust chamber of the compressor body and a pipe system extending from the exhaust chamber to the aftercooler, a gas injection port and a gas exhausting port formed in said screw compressor body and communicating with said working space of said compressor body, a first gas passage connected with said gas injection port for introducing a gas having passed through said aftercooler, a second gas passage connected with said gas exhaust port for exhausting the gas in the working space, and a first gas passage opening and closing means and a second gas passage opening and closing means respectively disposed in said first gas passage and in said second gas passage and controlled to be opened and closed based on a signal detected by said exhaust gas temperature detector.

3. A screw compressing apparatus as claimed in one of claims 1 or 2, wherein said gas injection port is located so as to face and outer peripheral surface of the rotor at a position near an end surface of the exhaust chamber side.

4. A screw compressing apparatus as claimed in one of claims 1 or 2, wherein said gas injection port is so located as to communicate with said working space only at a position located in at least an angular region extending from the exhaust process starting position towards the compression process starting position by an angular amount corresponding to one rotor tooth.

* * * * *